US007180232B2

(12) United States Patent
De Man et al.

(10) Patent No.: US 7,180,232 B2
(45) Date of Patent: Feb. 20, 2007

(54) LOW-PRESSURE MERCURY VAPOR DISCHARGE LAMP

(75) Inventors: Rolf Erwin De Man, Eindhoven (NL); Peter Hubertus Franciscus Deurenberg, Eindhoven (NL); Theodorus Maria Hendriks, Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 0 days.

(21) Appl. No.: 10/560,680

(22) PCT Filed: Jun. 15, 2004

(86) PCT No.: PCT/IB2004/050904

§ 371 (c)(1),
(2), (4) Date: Dec. 14, 2005

(87) PCT Pub. No.: WO2004/112085

PCT Pub. Date: Dec. 23, 2004

(65) Prior Publication Data

US 2006/0145608 A1 Jul. 6, 2006

(30) Foreign Application Priority Data

Jun. 19, 2003 (EP) ..... 03101807

(51) Int. Cl.
*H01J 1/62* (2006.01)
*H01J 63/04* (2006.01)
*H01J 9/38* (2006.01)

(52) U.S. Cl. ..... 313/490; 313/550; 313/547; 445/38

(58) Field of Classification Search ..... 313/490, 313/550, 547; 445/38
See application file for complete search history.

(56) References Cited

U.S. PATENT DOCUMENTS

| | | | | |
|---|---|---|---|---|
| 3,619,697 | A * | 11/1971 | Evans | 313/144 |
| 4,823,047 | A * | 4/1989 | Holmes et al. | 313/546 |
| 5,757,129 | A * | 5/1998 | Schafnitzel et al. | 313/565 |
| 5,917,276 | A * | 6/1999 | Traksel et al. | 313/490 |
| 6,310,437 | B1 * | 10/2001 | Blau et al. | 313/552 |
| 6,456,004 | B1 * | 9/2002 | Johnson et al. | 313/552 |

FOREIGN PATENT DOCUMENTS

JP 61047056 A * 3/1986

* cited by examiner

*Primary Examiner*—Nimeshkumar D. Patel
*Assistant Examiner*—Peter Macchiarolo

(57) ABSTRACT

Low-pressure mercury vapor discharge lamp comprises a light-transmitting discharge vessel (10) enclosing, in a gastight manner, a discharge space (13) provided with a filling of mercury and a rare gas. The discharge vessel comprises discharge means (20*a;* 20*b*) for maintaining a discharge in the discharge space. The discharge vessel is provided with a container comprising an amalgam (2). The container is provided with releasing means (4) for the controlled release of mercury vapor from the amalgam. The releasing means is open during lamp operation and is substantially closed when, during lamp operation, the temperature of the amalgam becomes higher than a pre-determined temperature. Preferably, the pre-determined temperature corresponds to a temperature of a range of temperatures at which the mercury-vapor pressure above the amalgam is relatively stable.

12 Claims, 6 Drawing Sheets

LOW-PRESSURE MERCURY VAPOR DISCHARGE LAMP

The invention relates to a low-pressure mercury vapor discharge lamp.

The invention also relates to a compact fluorescent lamp.

In mercury vapor discharge lamps, mercury constitutes the primary component for the (efficient) generation of ultraviolet (UV) light. A luminescent layer comprising a luminescent material may be present on an inner wall of the discharge vessel to convert UV to other wavelengths, for example, to UV-B and UV-A for tanning purposes (sun panel lamps) or to visible radiation for general illumination purposes. Such discharge lamps are therefore also referred to as fluorescent lamps. Alternatively, the ultraviolet light generated may be used for manufacturing germicidal lamps (UV-C). The discharge vessel of low-pressure mercury vapor discharge lamps is usually circular and comprises both elongate and compact embodiments. Generally, the tubular discharge vessel of compact fluorescent lamps comprises a collection of relatively short straight parts having a relatively small diameter, which straight parts are connected together by means of bridge parts or via bent parts. Compact fluorescent lamps are usually provided with an (integrated) lamp cap. Normally, the means for maintaining a discharge in the discharge space are electrodes arranged in the discharge space. In an alternative embodiment the low-pressure mercury vapor discharge lamp comprises a so-called electrodeless low-pressure mercury vapor discharge lamp.

In the description and claims of the current invention, the designation "nominal operation" is used to refer to operating conditions where the mercury-vapor pressure is such that the radiation output of the lamp is at least 80% of that when the light output is maximal, i.e. under operating conditions where the mercury-vapor pressure is optimal. In addition, in the description and claims, the "initial radiation output" is defined as the radiation output of the discharge lamp 1 second after switching on the discharge lamp, and the "run-up time" is defined as the time needed by the discharge lamp to reach a radiation output of 80% of that during optimum operation.

Low-pressure mercury-vapor discharge lamps are known comprising an amalgam. Such discharge lamps have a comparatively low mercury-vapor pressure at room temperature. As a result, amalgam-containing discharge lamps have the disadvantage that also the initial radiation output is comparatively low when a customary power supply is used to operate said lamp. In addition, the run-up time is comparatively long because the mercury-vapor pressure increases only slowly after switching on the lamp. Apart from amalgam-containing discharge lamps, low-pressure mercury-vapor discharge lamps are known which comprise both a (main) amalgam and a so-called auxiliary amalgam. If the auxiliary amalgam comprises sufficient mercury, then the lamp has a relatively short run-up time. Immediately after the lamp has been switched on, i.e. during pre-heating the electrodes, the auxiliary amalgam is heated by the electrode so that it relatively rapidly dispenses a substantial part of the mercury that it contains. In this respect, it is desirable that, prior to being switched on, the lamp has been idle for a sufficiently long time to allow the auxiliary amalgam to take up sufficient mercury. If the lamp has been idle for a comparatively short period of time, the reduction of the run-up time is only small. In addition, in that case the initial radiation output is (even) lower than that of a lamp comprising only a main amalgam, which can be attributed to the fact that a comparatively low mercury-vapor pressure is adjusted in the discharge space by the auxiliary amalgam. An additional problem encountered with comparatively long lamps is that it takes comparatively much time for the mercury liberated by the auxiliary amalgam to spread throughout the discharge vessel, so that after switching on such lamps, they demonstrate a comparatively bright zone near the auxiliary amalgam and a comparatively dark zone at a greater distance from the auxiliary amalgam, which zones disappear after a few minutes.

In addition, low-pressure mercury-vapor discharge lamps are known which are not provided with an amalgam and contain only free mercury. These lamps, also referred to as mercury discharge lamps, have the advantage that the mercury-vapor pressure at room temperature and, hence, the initial radiation output are relatively high as compared to amalgam-containing discharge lamps and as compared to discharge lamps comprising a (main) amalgam and an auxiliary amalgam. In addition, the run-up time is comparatively short. After having been switched on, comparatively long lamps of this type also demonstrate a substantially constant brightness over substantially the whole length, which can be attributed to the fact that the vapor pressure (at room temperature) is sufficiently high at the time of switching on these lamps.

U.S. Pat. No. 6,456,004 discloses an apparatus for improving the performance of a low-pressure mercury vapor discharge lamp. The lamp includes an envelope enclosing an amalgam housed in a container. The container maintains mercury vapor equilibrium during lamp operation and prevents mercury diffusion during lamp off periods. The container is provided with an opening selectively adjustable between an open position and a closed position. When the discharge lamp is in operation, the container is in an open position enabling the amalgam to maintain mercury vapor pressure equilibrium. When the discharge lamp is turned off, the container is closed preventing diffusion of mercury into the amalgam.

A drawback of the known low-pressure mercury vapor discharge lamp is that the mercury pressure becomes too high when they are operated in a badly ventilated luminaire or when the discharge lamp is subjected to a high load. As the saturation vapor pressure increases exponentially with temperature, comparatively high ambient temperatures give rise to a reduction of the radiation output.

The invention has for its object to eliminate the above disadvantage wholly or partly. According to the invention, a low-pressure mercury vapor discharge lamp of the kind mentioned in the opening paragraph for this purpose comprises:

a light-transmitting discharge vessel enclosing, in a gastight manner, a discharge space provided with a filling of mercury and a rare gas, the discharge vessel comprising discharge means for maintaining a discharge in the discharge space, the discharge vessel being provided with a container comprising an amalgam, the container being provided with releasing means for the controlled release of mercury vapor from the amalgam, the releasing means being open during lamp operation, the releasing means being substantially closed when, during lamp operation, the temperature of the amalgam becomes higher than a pre-determined temperature.

In the description and claims of the current invention, the designation "substantially closed" is used to refer to operating conditions in the low-pressure mercury vapor discharge lamp where the releasing means is not entirely closed, while a relatively small passageway between the amalgam container and the discharge space is left open.

Maintaining mercury vapor pressure equilibrium in fluorescent lamps is necessary to maintain optimum lumen output during extended periods when the discharge lamp is in operation. According to the invention, the releasing means is substantially closed when the temperature of the amalgam becomes higher than a pre-determined temperature. When the temperature of the amalgam becomes higher than the pre-determined temperature, the communication between the amalgam and the discharge space is blocked implying that the mercury pressure in the discharge lamp can not rise further with increasing (ambient) temperature. As a consequence, the low-pressure mercury vapor discharge lamp according to the invention operates at a relatively constant lumen output even if the ambient temperature becomes higher than the pre-determined temperature. If the ambient temperature rises after the releasing means has been closed, the vapor pressure above the amalgam in the container may increase, but this has no effect on the mercury pressure in the discharge space because the vapor formed above the amalgam in the container cannot reach the discharge space. According to the measure of the invention, nominal operation of the low-pressure mercury vapor discharge lamp is achieved even at relatively high ambient lamp temperatures. Even in a badly ventilated luminaire or when the lamp is subjected to a high load, an optimal lead to a reduction of the radiation output, a low-pressure mercury vapor discharge lamp is obtained with an optimal radiation output.

Preferably, the pre-determined temperature corresponds to a temperature of a range of temperatures at which the mercury-vapor pressure above the amalgam is relatively stable. According to this embodiment of the invention, nominal operation of the low-pressure mercury vapor discharge lamp is achieved even at high lamp temperatures because the discharge space contains (just) enough mercury to bring about a mercury-vapor pressure at the operating temperature which is close to the optimum mercury-vapor pressure. When, during the service life of the discharge lamp, mercury is lost because it becomes bound, for example, to a wall of the discharge vessel and/or to emitter material, the closing means will remain open for a longer period when the discharge lamp is ignited. In this manner, the burning conditions of the low-pressure mercury vapor discharge lamp are relatively optimal under all circumstances and at each moment in the service life of the discharge lamp. The range of temperatures at which the mercury-vapor pressure above the amalgam is relatively stable corresponds to the temperature range of the so-called amalgam plateau.

A preferred embodiment of the low-pressure mercury vapor discharge lamp according to the invention is characterized in that the pre-determined temperature corresponds to 75–110% of the lowest temperature of the range of temperatures at which the mercury-vapor pressure above the amalgam is relatively stable.

Preferably, the releasing means is open during lamp-off periods. When the lamp is switched off, the decrease in temperature causes the mercury vapor to navigate to and diffuse into the amalgam. In general, the releasing means will open again when during the discharge lamp is in operation the temperature drops below the pre-determined temperature.

A preferred embodiment of the low-pressure mercury vapor discharge lamp according to the invention is characterized in that the releasing means comprises a resilient means made of a shape-memory alloy, the transformation temperature of the shape-memory alloy being chosen to correspond substantially to the pre-determined temperature, the resilient means being substantially closed when the shape-memory alloy reaches the transformation temperature of the shape-memory alloy. The characteristics of the shape-memory alloy are chosen such that the transformation temperature corresponds to the pre-determined temperature.

A preferred embodiment of the low-pressure mercury vapor discharge lamp according to the invention is characterized in that the product of the mercury pressure $p_{Hg}$ and the internal diameter $D_{in}$ of the discharge vessel is in the range $0.13 \leqq p_{Hg} \times D_{in} \leqq 8$ Pa·cm. A discharge vessel of a low-pressure mercury vapor discharge lamp in which the product of the mercury pressure (expressed in Pa) and the internal diameter (expressed in mm) of the discharge vessel which is in the mentioned range, contains a relatively low amount of mercury. The mercury content is considerably lower than what is normally provided for in known low-pressure mercury vapor discharge lamps. The low-pressure mercury vapor discharge lamp according to this embodiment of the invention operates as a so-called "unsaturated" mercury vapor discharge lamp.

Preferably, the product of the mercury pressure $p_{Hg}$ and the internal diameter $D_{in}$ of the discharge vessel is in the range $0.13 \leqq p_{Hg} \times D_{in} \leqq 4$ Pa·cm. In this preferred regime of $p_{Hg} \times D_{in}$, the mercury content in the discharge lamp is further reduced. In this preferred embodiment of the invention, the low-pressure mercury vapor discharge lamp according to the invention operates as an unsaturated mercury vapor discharge lamp.

A preferred embodiment of the low-pressure mercury vapor discharge lamp according to the invention is characterized in that the discharge vessel contains less than approximately 0.1 mg mercury. There is a tendency in governmental regulations to prescribe a maximum amount of mercury present in a low-pressure mercury vapor discharge lamp that if the discharge lamp comprises less than said prescribed amount allows the user to dispose of the lamp without environmental restrictions. If a mercury discharge lamp contains less than 0.2 mg of mercury such requirements are largely fulfilled. Preferably, the discharge vessel contains less than or equal to approximately 0.05 mg mercury.

It is not an easy task to operate a low-pressure mercury vapor discharge lamp under unsaturated mercury conditions while simultaneously realizing a relatively long life of the discharge lamp. It is known that measures are taken in low-pressure mercury vapor discharge lamps to reduce the amount of mercury that during life of the discharge lamp is no longer able to contribute to the reactive atmosphere in the discharge space in the discharge vessel. Mercury is lost in that, due to the interaction of mercury and materials present in the lamp (such as glass, coatings, electrodes) and parts of the inner wall of the discharge vessel are blackened. Wall blackening does not only give rise to a lower light output but also gives the lamp an unaesthetic appearance, particularly because the blackening occurs irregularly, for example, in the form of dark stains or dots.

These and other aspects of the invention are apparent from and will be elucidated with reference to the embodiments described hereinafter.

In the drawings.

The Figures are purely diagrammatic and not drawn to scale. Notably, some dimensions are shown in a strongly exaggerated form for the sake of clarity. Similar components in the Figures are denoted as much as possible by the same reference numerals.

Figure 1A:
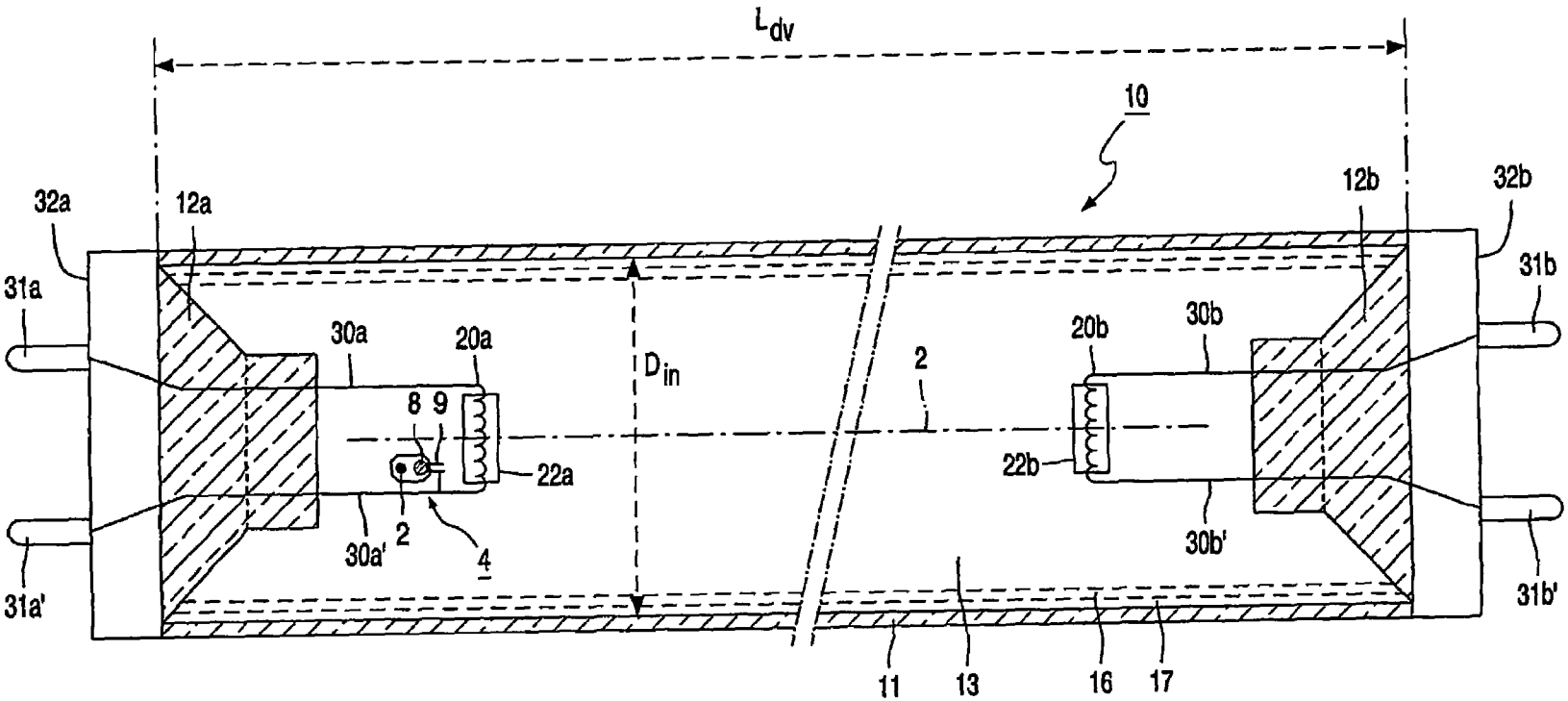
FIG. 1A is a cross-sectional view of an embodiment of the low-pressure mercury-vapor discharge lamp in accordance with the invention in longitudinal section.

FIG. 1A shows a low-pressure mercury-vapor discharge lamp comprising a glass discharge vessel having a tubular portion 11 about a longitudinal axis 2, which discharge vessel transmits radiation generated in the discharge vessel 10 and is provided with a first and a second end portion 12*a*; 12*b*, respectively. In this example, the tubular portion 11 has a length $L_{dv}$ of 120 cm and an inside diameter $D_{in}$ of 24 mm. The discharge vessel 10 encloses, in a gastight manner, a discharge space 13 containing a filling of mercury and an inert gas mixture comprising for example argon. The side of the tubular portion 11 facing the discharge space 13 is provided with a protective layer 17. In fluorescent discharge lamps, the side of the tubular portion 11 facing the discharge space 13 is, in addition, coated with a luminescent layer 16 which includes a luminescent material (for example a fluorescent powder) which converts the ultraviolet (UV) light generated by fallback of the excited mercury into (generally) visible light.

In the example of FIG. 1A discharge means for maintaining a discharge in the discharge space 13 are electrodes 20*a*; 20*b* arranged in the discharge space 13, said electrodes 20*a*; 20*b* being supported by the end portions 12*a*; 12*b*. The electrode 20*a*; 20*b* is a winding of tungsten covered with an electron-emitting substance, in this case a mixture of barium oxide, calcium oxide and strontium oxide. Current-supply conductors 30*a*, 30*a*'; 30*b*, 30*b*' of the electrodes 20*a*; 20*b*, respectively, pass through the end portions 12*a*; 12*b* and issue from the discharge vessel 10 to the exterior. The current-supply conductors 30*a*, 30*a*'; 30*b*, 30*b*' are connected to contact pins 31*a*, 31*a*'; 31*b*, 31*b*' which are secured to a lamp cap 32*a*, 32*b*. In general, around each electrode 20*a*; 20*b* an electrode ring is arranged (not shown in FIG. 1A) on which a glass capsule for proportioning mercury is clamped.

In the example shown in FIG. 1A, the electrode 20*a*; 20*b* is surrounded by an electrode shield 22*a*; 22*b* which, preferably, is made from a ceramic material. Preferably, the electrode shield 22*a*; 22*b* is made from a ceramic material comprising aluminum oxide. Particularly suitable electrode shields are manufactured from so-called densely sintered $Al_2O_3$, also referred to as DGA.

An alternative embodiment of the low-pressure mercury vapor discharge lamp comprises the so-called electrodeless discharge lamps, in which the discharge means for maintaining an electric discharge are situated outside a discharge space surrounded by the discharge vessel. Generally said means are formed by a coil provided with a winding of an electric conductor, with a high-frequency voltage, for example having a frequency of approximately 3 MHz, being supplied to said coil, in operation. In general, said coil surrounds a core of a soft-magnetic material.

According to the invention, the discharge vessel 10 is provided with a container (the container is not shown in FIG. 1A; see FIG. 3A for more details) provided with an amalgam 2. The container is provided with releasing means 4 for the controlled release of mercury vapor from the amalgam 2. During lamp operation the releasing means 4 is normally open. However, the releasing means 4 is substantially closed when, during lamp operation, the temperature of the amalgam 2 becomes higher than a pre-determined temperature. In the example of FIG. 1A the releasing means 4 comprising the amalgam 2 is attached to current-supply conductor 30*a*'.

Figure 1B:
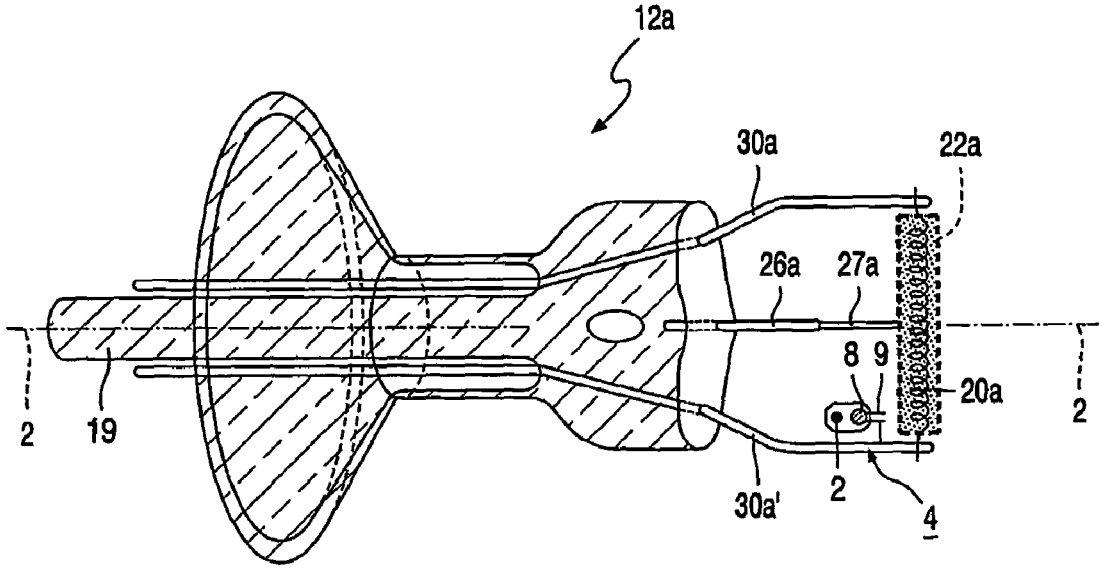
FIG. 1B shows a detail of FIG. 1A, which is partly drawn in perspective.

FIG. 1B is a partly perspective view of a detail shown in FIG. 1A, the end portion 12*a* supporting the electrode 20*a* via the current supply conductors 30*a*, 30*a*'. The releasing means 4 for the controlled release of mercury vapor from the amalgam 2 is connected to the current-supply conductor 30*a*'. During lamp operation the releasing means 4 is open. However, the releasing means 4 is substantially closed when, during lamp operation, the temperature of the amalgam 2 becomes higher than a pre-determined temperature. In the example of FIG. 1B the releasing means 4 comprising the amalgam 2 is attached to current-supply conductor 30*a*'. In an alternative embodiment the releasing means comprising the amalgam is connected to the exhaust tube 19 of the end portion 12*a* or to the electrode shield 22*a*.

Figure 2A:
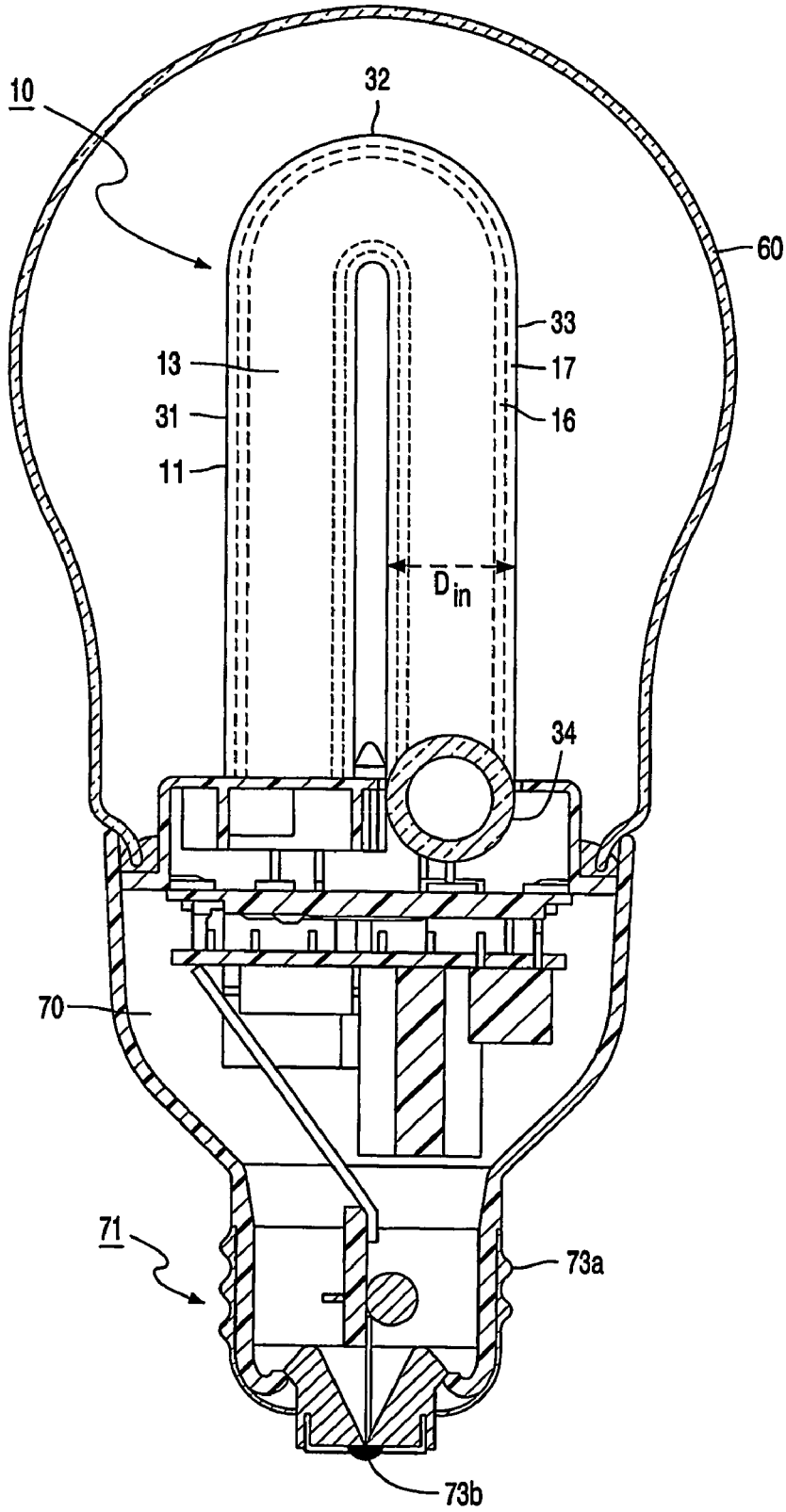
FIG. 2A is a cross-sectional view of an embodiment of a compact fluorescent lamp comprising a low-pressure mercury vapor discharge lamp according to the invention.
Figure 2B:
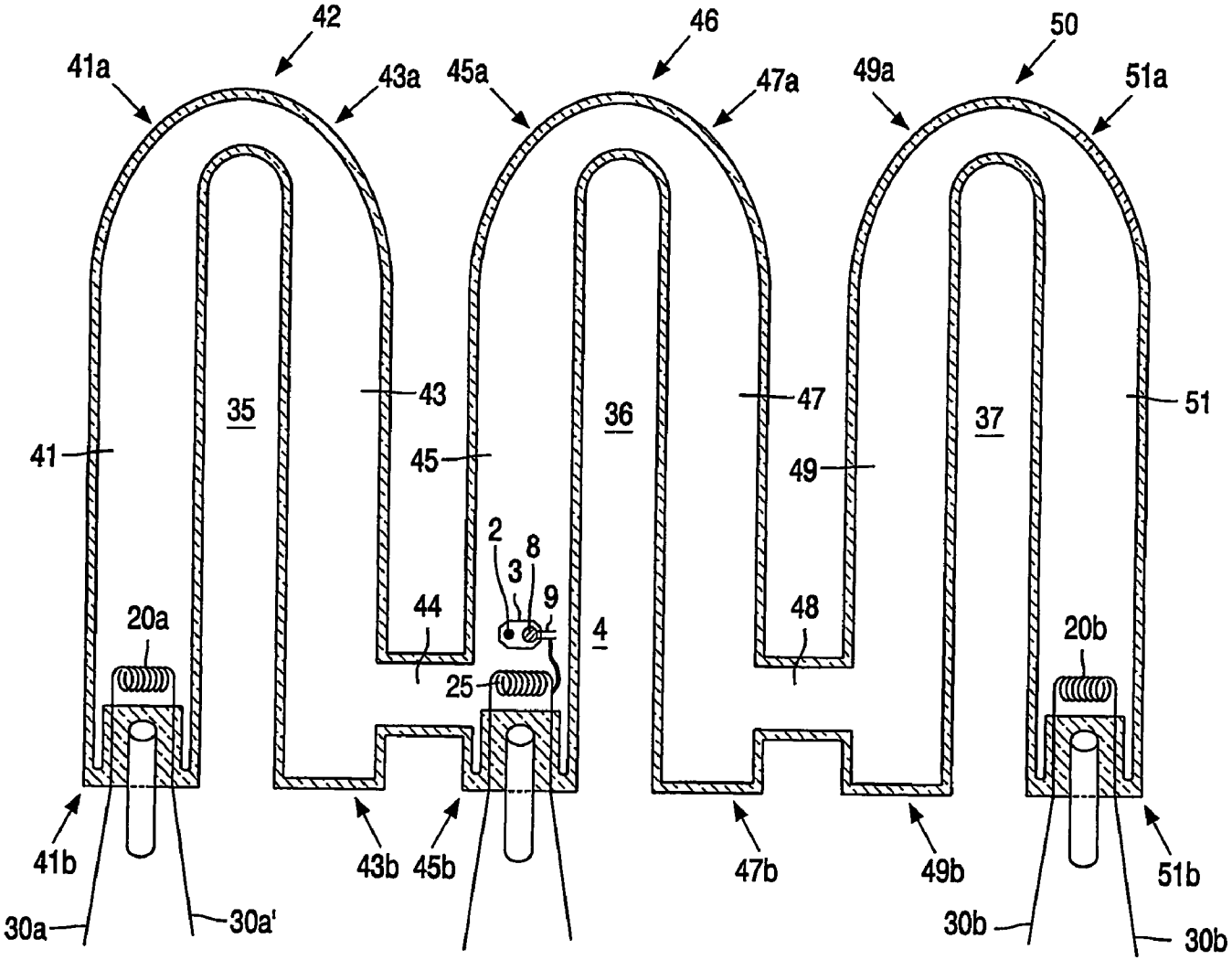
FIG. 2B is a cross-sectional view of the discharge vessel of the compact fluorescent lamp as shown in FIG. 2A.

FIG. 2A shows a compact fluorescent lamp comprising a low-pressure mercury vapor discharge lamp. FIG. 2B shows a cross-sectional view of the discharge vessel of the compact fluorescent lamp as shown in FIG. 2A. Similar components in FIGS. 2A and 2B are denoted as much as possible by the same reference numerals as in FIGS. 1A and 1B. The low-pressure mercury-vapor discharge lamp is in this case provided with a radiation-transmitting discharge vessel 10 having a tubular portion 11 enclosing, in a gastight manner, a discharge space 13 having a volume of approximately 25 $cm^3$. The discharge vessel 10 is a glass tube which is at least substantially circular in cross-section and the (effective) internal diameter $D_{in}$ of which is approximately 10 mm. In this example, the tubular portion 11 has a total length $L_{dv}$ (not shown in FIG. 2A) of 40 cm. The tube is bent in the form of a so-called hook and, in this embodiment, it has a number of straight parts, two of which, referenced 31, 33, are shown in FIG. 2A. The discharge vessel further comprises a number of bent or arc-shaped parts, two of which, referenced 32, 34, are shown in FIG. 2A. In an alternative embodiment, the discharge vessel comprises a number of bridge portions. The side of the tubular portion 11 facing the discharge space 13 is provided with a protective layer 17 and with a luminescent layer 16. In an alternative embodiment, the luminescent layer has been omitted. The discharge vessel 10 as shown in FIG. 2A is: [redacted] housing 70 which also supports a lamp cap 71 provided with electrical and mechanical contacts 73*a*, 73*b*, which are known per se. In addition, the discharge vessel 10 is surrounded by a light-transmitting envelope 60 which is attached to the lamp housing 70. The light-transmitting envelope 60 generally has a matt appearance. The releasing means for the controlled release of mercury vapor from the amalgam is not shown in FIG. 2A.

FIG. 2B shows a cross-sectional view of the discharge vessel of the compact fluorescent lamp as shown in FIG. 2A. The compact fluorescent lamp comprises at least two dual-shaped lamp parts 35; 36; 37. Each dual-shaped lamp parts 35; 36; 37 comprises a first tube 41; 45; 49 and a second tube 43; 47; 51. In the example of FIG. 2B the compact fluorescent lamp comprises three dual-shaped lamp parts referenced 35; 36, 37. The first tube 41; 45; 49 and the second tube 43; 47; 51 at a first end portion 41*a*, 43*a*; 45*a*, 47*a*; 49*a*, 51*a* of each tube 41, 43; 45, 47; 49, 51 are interconnected via a tube interconnectionmeans 42; 46; 50. In the example of FIG. 2B, the tube interconnection means 42; 46; 50 comprise so-called bent portions. In an alternative embodiment the tube interconnection means comprise so-called bridge portions.

In the compact fluorescent lamp as shown in FIG. 2B a discharge path is formed through the tubes 41, 43; 45, 47; 49, 51 between a fist electrode 20*a* and a second electrode 20*b*.

The first electrode 20*a* is provided at a second end portion referenced 41*b* of the tube referenced 41. The second electrode 20*b* is provided at a second end portion referenced 51*b* of the tube referenced 51. The second end portions 41*b*; 51*b* face away from the first end portions 41*a*; 51*a*. To obtain a relatively long electrode path, the electrodes 20*a*; 20*b* are arranged at extreme ends of the fluorescent lamp.

In the example of FIG. 2B the first and second electrodes 20*a*; 20*b* are supported by the respective second end portions 41*b*; 51*b*. Current-supply conductors 30*a*, 30*a*'; 30*b*, 30*b*' of the electrodes 20*a*; 20*b* respectively, pass through the second end portions 41*b*; 51*b* and issue from the discharge lamp to the exterior.

The side of the tubes 41, 43; 45, 47; 49, 51 facing the discharge space is preferably provided with a protective layer (not shown in FIG. 2B). The side of the tubes 41, 43; 45, 47; 49, 51 facing the discharge space is, in addition, coated with a luminescent layer (not shown in FIG. 2B) which includes a luminescent material (for example a fluorescent powder) which converts the ultraviolet (UV) light generated by fallback of the excited mercury into (generally) visible light.

Apart from the second end portions 41*b*; 51*b* provided with an electrode 20*a*; 20*b*, further second end portions 43*b*; 45*b*; 47*b*; 49*b* of the respective tubes 43; 45; 47; 49 are provided with a sealed end. Bridge parts 44; 48 for mutually connecting tubes 43, 45; 47, 49 of adjacent dual-shaped lamp parts 35, 36; 36, 37 are provided in the proximity of the second end portions 43*b*, 45*b*; 47*b*, 49*b* of the tubes 43, 45; 47, 49. At least one of the further second end portions 45*b* is provided with the container 3 comprising the amalgam 2.

In the example of FIG. 2B, a heating means 25 is provided at the further second end portion 45*b*. The heating means 45*b* is used to heat the amalgam 2 in the container 3 to the desired temperature at the desired moment. Preferably, the heating means 25 is a winding of tungsten and is not covered with an electron-emitting substance. The heating means 25 may be covered by a protective coating. By providing an amalgam which can be heated independent of the first and second electrode 20*a*; 20*b*, the compact fluorescent lamp can be operated under so-called unsaturated conditions. Only when the mercury content is lower than a certain predetermined level, the heating means 25 is heated whereby the release of mercury from the amalgam 2 in container 3 is regulated. Preferably, the housing 70 contains regulating means for regulating, via the heating means 25, the temperature of the amalgam 2 in the container 3. The regulating means may be implemented in software and/or in hardware. By employing one of the "unused" second end portions of the compact fluorescent lamp, a compact embodiment of the low-pressure mercury vapor discharge lamp according to the invention is realized.

Operating a mercury vapor discharge lamp under unsaturated mercury conditions has a number of advantages. Generally speaking, the performance of unsaturated mercury discharge lamps (light output, efficacy, power consumption, etc.) is independent of the ambient temperature as long as the mercury pressure is unsaturated. This results in a constant light output which is independent on the way of burning the discharge lamp (base up versus base down, horizontally versus vertically). In practice, a higher light output of the unsaturated mercury vapor discharge lamp is obtained in the application. Unsaturated lamps combine a higher light output and an improved efficacy in applications at elevated temperatures with minimum mercury content. This results in ease of installation and in freedom of design for lighting and luminaire designers. An unsaturated mercury discharge lamp gives a relatively high system efficacy in combination with a relatively low Hg content. In addition, unsaturated lamps have an improved maintenance. Because the trends towards further miniaturization and towards more light output from one luminaire will continue the forthcoming years, it may be anticipated that problems with temperature in application will more frequently occur in the future. With an unsaturated mercury vapor discharge lamp these problems are largely reduced. Unsaturated lamps combine minimum mercury content with an improved lumen per Watt performance at elevated temperatures.

Figure 3A:
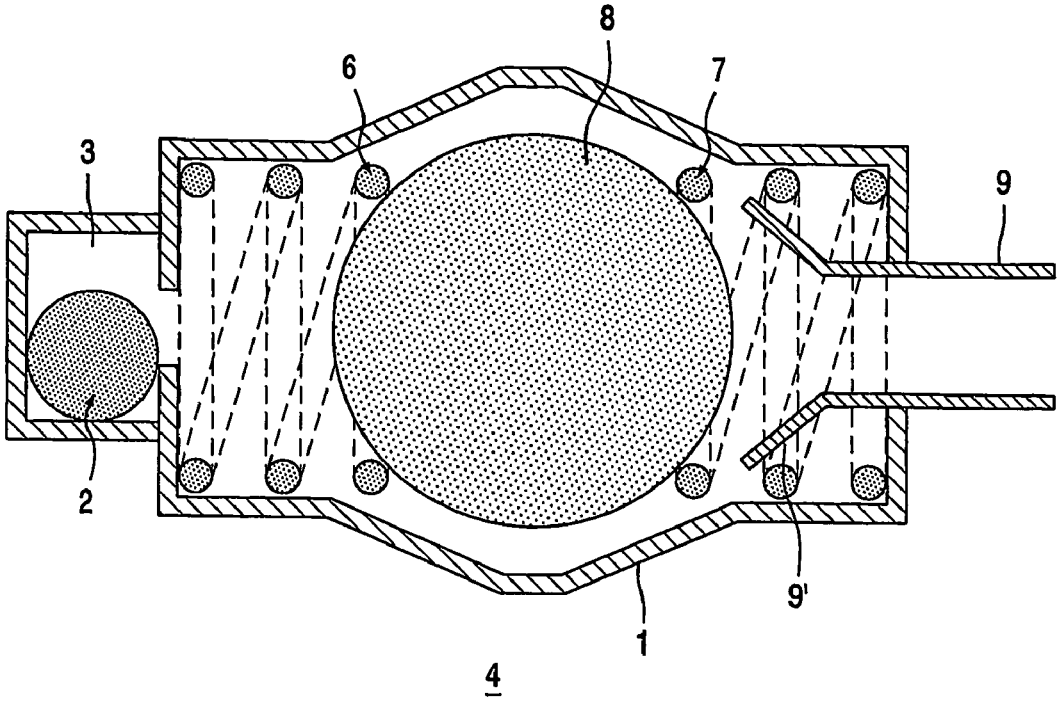
FIG. 3A shows an embodiment of the releasing means in the open state according to the invention.
Figure 3B:
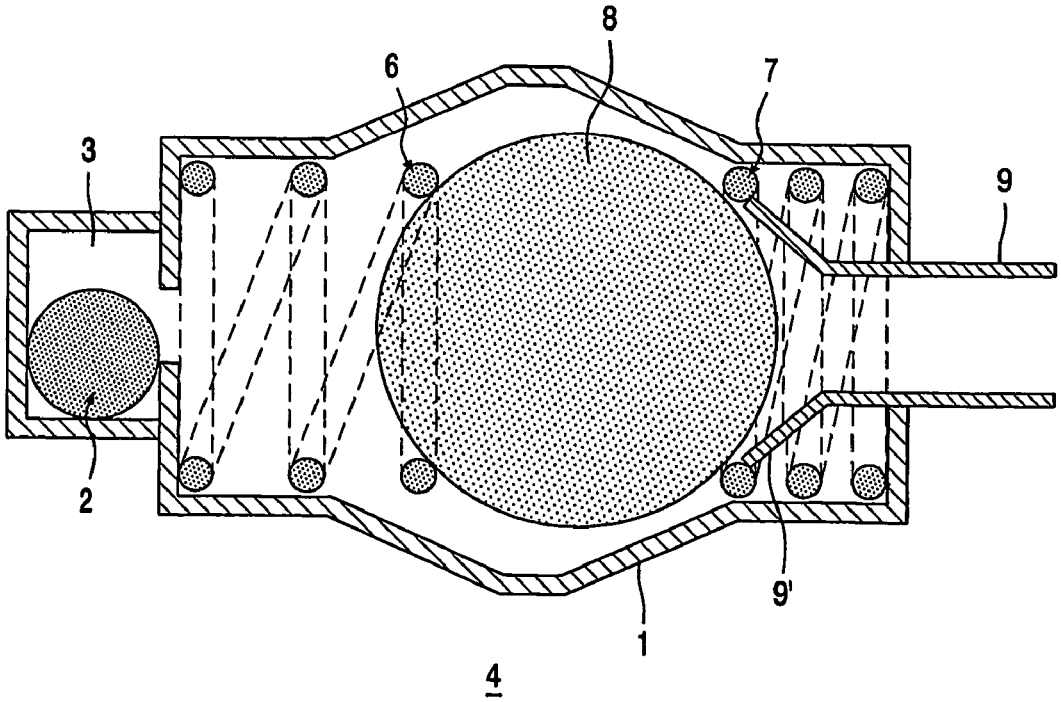
FIG. 3B shows an embodiment of the releasing means in the closed state according to the invention.

FIG. 3A shows an embodiment of the releasing means in the open state according to the invention and FIG. 3B shows an embodiment of the releasing means in the closed state according to the invention. In the example of FIG. 3A, the releasing means 4 comprises a resilient means 6 made of a shape-memory alloy in a housing 1. Communication between the container 3 provided with the amalgam 2 and the discharge space 13 of the discharge vessel 10 is controlled via the releasing means 4. The releasing means 4 regulates the release of mercury vapor from the amalgam 2 to the discharge space 13. According to the invention, the transformation temperature of the shape-memory alloy is chosen to correspond substantially to a pre-determined temperature. Preferably, the pre-determined temperature corresponds to a temperature of a range of temperatures at which the mercury-vapor pressure above the amalgam 2 is relatively stable. In particular, the pre-determined temperature corresponds to 75–110% of the lowest temperature of the range of temperatures at which the mercury-vapor pressure above the amalgam 2 is relatively stable.

When the shape-memory alloy reaches the transformation temperature of the shape-memory alloy the resilient means 6 is substantially closed (see FIG. 3B). As long as the shape-memory alloy is above the transformation temperature of the shape-memory alloy, the resilient means 6 remains substantially closed and the communication between the amalgam and the discharge space is severed.

The construction of the releasing means 4 as shown in FIGS. 3A and 3B comprises a resilient means 6 (a spring) made of shape-memory alloy, a closing means 8, an addition ordinary spring 7 and a ferrule 9 with a flaring portion 9' facing the closing means 8. The releasing means 4 as shown in FIGS. 3A and 3B operates as follows. At temperatures below the transition temperature $T_0$ of the shape-memory alloy, the resilient means is deformed by the ordinary spring 7 and the closing means 8 is in approximately in the middle of the releasing means enabling communication between the amalgam 2 in the container 3 and the discharge space 13 (see FIG. 3A). Above the transition temperature $T_0$ the shape-memory alloy, the resilient means regains its original form and pushes the closing means 8 towards the flaring portion 9' of the ferrule 9. Eventually the closing means engages with the flaring portion 9' of the ferrule 9 and closes the contact between the amalgam 2 and the discharge space (see FIG. 3B). In the example of FIGS. 3A and 3B a closing means 8 shaped as a ball is used. The ball is made, for instance, of metal, glass or a ceramic material. Alternative geometries are possible.

According to the invention, the transition or threshold temperature $T_0$ of the shape-memory alloy matches with the amalgam plateau temperatures. In the event that parts of the releasing means 4 react with mercury, such parts are preferably coated. The housing 1 is, preferably made of glass.

Nominal operation of the low-pressure mercury vapor discharge lamp is achieved even at high lamp temperatures because the discharge space contains (just) enough mercury to bring about a mercury-vapor pressure at the operating temperature which is close to the optimum mercury-vapor pressure. When, during the service life of the discharge lamp, mercury is lost because it becomes bound, for example, to a wall of the discharge vessel and/or to emitter material, the closing means will remain open for a longer period when the discharge lamp is ignited. In this manner, the burning conditions of the low-pressure mercury vapor discharge lamp are relatively optimal under all circumstances and at each moment in the service life of the discharge lamp.

The range of temperatures at which the mercury-vapor pressure above the amalgam is relatively stable corresponds to the temperature range of the so-called amalgam plateau. The advantages of the low-pressure mercury vapor discharge lamp according to the invention are that the releasing means 4 can be relatively small. The low-pressure mercury vapor discharge lamp behaves unsaturated at high temperatures. In addition, one matched combination of an amalgam plateau and the transition temperature $T_0$ of the shape-memory alloy suffices for a whole range of lamps operated at elevated temperatures. Unsaturated low-pressure mercury vapor discharge lamps generate a constant light output which is practically independent of the temperature of the discharge vessel. The run-up behavior of unsaturated discharge lamps is similar to that of a normal mercury discharge lamp.

The term shape-memory alloys is applied to a group of metallic materials that demonstrate the ability to return to some previously defined shape or size when subjected to the appropriate thermal procedure. Generally, these materials can be plastically deformed at some relatively low temperature, and upon exposure to some higher temperature will return to their shape prior to the deformation. Materials that exhibit shape memory only upon heating are referred to as having a one-way shape memory. Some materials also undergo a change in shape upon re-cooling. These materials have a two-way shape memory.

Although a relatively wide variety of alloys are know to exhibit the shape memory effect, only those that can recover substantial amounts of strain or that generate significant force upon changing shape are of commercial interest. To date, this has been the nickel-titanium alloys and copper-base alloys such as CuZnAl and CuAlNi.

A shape memory alloy may be further defined as one that yields a thermo-elastic martensite. In this case, the alloy undergoes a martensitic transformation of a type that allows the alloy to be deformed by a twinning mechanism below the transformation temperature. The deformation is then reversed when the twinned structure reverts upon heating to the parent phase. The martensitic transformation that occurs in the shape-memory alloys yields a thermo-elastic martensite and develops from a high-temperature austenite phase with long-range order. The martensite typically occurs as alternately sheared platelets, which are seen as a herringbone structure when viewed metallographically. The transformation, although a first-order phase change, does not occur at a single temperature but over a range of temperatures that varies with each alloy system. Most of the transformation occurs over a relatively narrow temperature range, although the beginning and end of the transformation during heating or cooling actually extends over a much larger temperature range. The transformation also exhibits hysteresis in that the transformations on heating and on cooling do not overlap. This transformation hysteresis varies with the alloy system.

A suitable example of a shape-memory alloy is Flexinol™. Wires made of Flexinol are highly processed strands of nickle-titanium alloy (called nitinol) a shape-memory alloy that assumes a radically different crystalline structure at differing temperatures. At room temperatures, wires made of Flexinol are easily stretched by a small force. However, when heated to above their transition temperature either by a source of heat or by a small electric current, they change to a much "harder" form and the wire returns to its unstretched length: the wire shortens with a useable amount of force.

Figure 4:
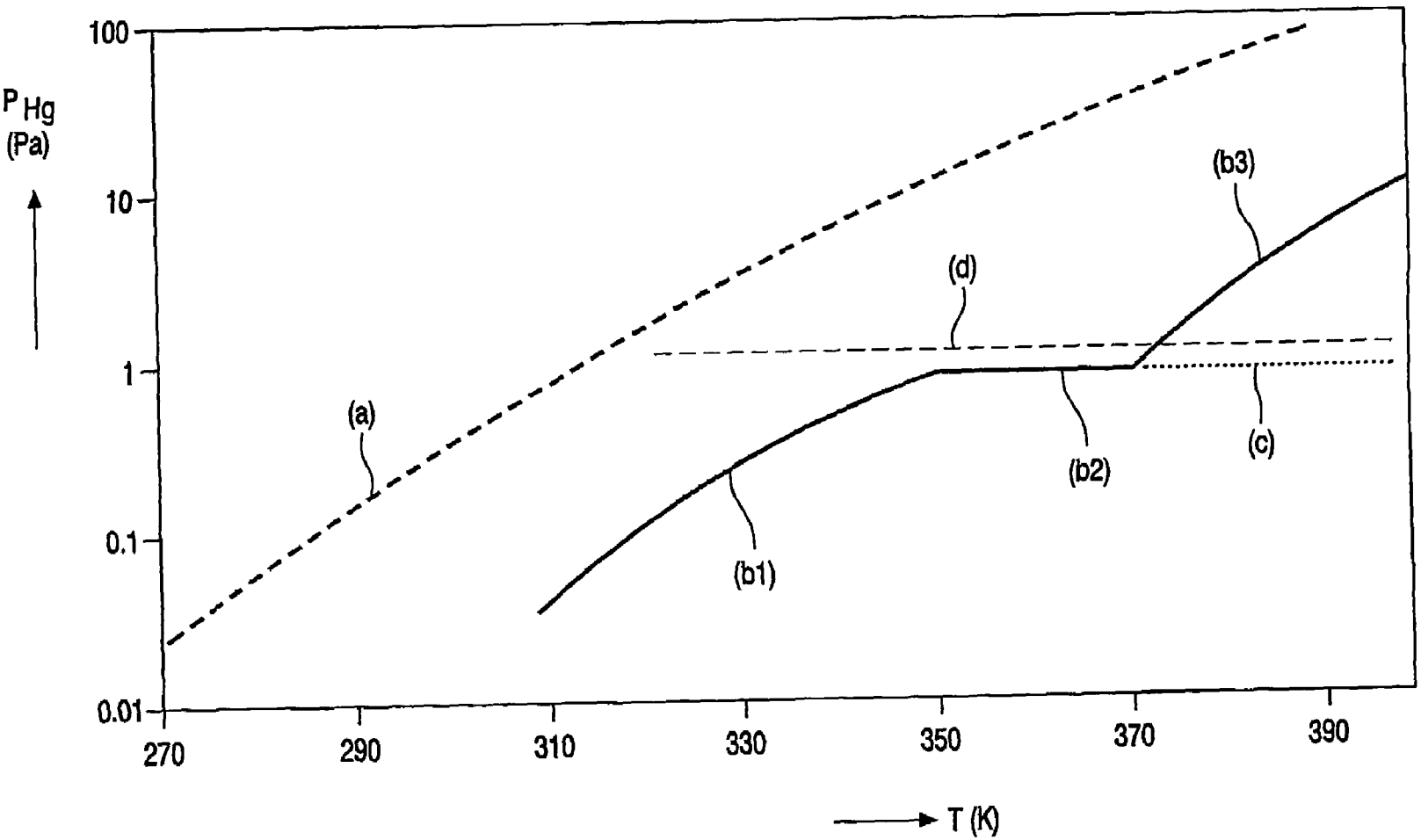
FIG. 4 shows the mercury pressure as a function of temperature.

FIG. 4 schematically shows the mercury pressure $p_{Hg}$ (in Pa) as a function of temperature T (in Kelvin). Curve (a) in FIG. 4 shows a typical behavior of a low-pressure mercury vapor discharge lamp which is not provided with an amalgam and contains only free mercury. The mercury pressure exhibits a steady increase with increasing temperature.

Curves (b1), (b2) and (b2) in FIG. 4 shows a typical behavior of a low-pressure mercury vapor discharge lamp provided with an amalgam. The mercury pressure exhibits for the parts (b1) and (b3) shows a typical steady increase with increasing temperature. In a certain range of temperatures, the mercury-vapor pressure above the amalgam is relatively stable. This temperature range corresponds to the so-called amalgam plateau and is shown in FIG. 4 with part (b2). If the temperature becomes higher than the temperatures at which the mercury-vapor pressure above the amalgam is relatively stable, the mercury pressure increases again which is shown in FIG. 4 with part (b3).

According to the invention, the communication between the amalgam 2 and the discharge space 13 is blocked when the temperature of the shape-memory metal is approximately equal to the plateau temperature of the amalgam. This implies that the mercury pressure in the discharge lamp can not rise further with increasing (ambient) temperature. For higher temperatures in stead of curve (b3) the mercury pressure will behave according to curve (c). If the ambient temperature rises after the releasing means has been closed, the vapor pressure above the amalgam in the container may increase, but this has no effect on the mercury pressure in the discharge space because the vapor formed above the amalgam in the container cannot reach the discharge space. According to the measure of the invention, nominal operation of the low-pressure mercury vapor discharge lamp is achieved even at relatively high ambient lamp temperatures. Even in a badly ventilated luminaire or when the lamp is subjected to a high load, an optimal lead to a reduction of the radiation output, a low-pressure mercury vapor discharge lamp is obtained with an optimal radiation output.

Curve (d) in FIG. 4 shows the behavior of a low-pressure mercury vapor discharge lamp which operates under unsaturated conditions. A can be seen, the behavior of the mercury pressure as a function of temperature of a low-pressure mercury vapor discharge lamp according to the invention, as represented by curves (b1), (b2) and (c) in FIG. 4 is always below that of a low-pressure mercury vapor discharge lamp operating at unsaturated conditions. Unsaturated low-pressure mercury vapor discharge lamps have a relatively constant light output which, above a certain temperature (for instance 42° C.), is independent of the temperature of the discharge vessel. The run-up behavior of unsaturated discharge lamps is similar to that of a normal mercury discharge lamp and faster than for a low-pressure mercury vapor discharge lamp comprising an amalgam.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A low-pressure mercury vapor discharge lamp comprising: a light-transmitting discharge vessel (10) enclosing, in a gastight manner, a discharge space (13) provided with a filling of mercury and a rare gas, the discharge vessel (10) comprising discharge means for maintaining a discharge in the discharge space (13), the discharge vessel (10) being provided with a container (3) comprising an amalgam (2), the container (3) being provided with releasing means (4) for the controlled release of mercury vapor from the amalgam (2), the releasing means (4) being open during lamp operation when the temperature of the amalgam is lower than a predetermined temperature, the releasing means (4) being substantially closed when, during lamp operation, the temperature of the amalgam (2) becomes higher than the predetermined temperature.

2. A low-pressure mercury vapor discharge lamp as claimed in claim 1, characterized in that the pre-determined temperature corresponds to a temperature of a range of temperatures at which the mercury-vapor pressure above the amalgam (2) is relatively stable.

3. A low-pressure mercury vapor discharge lamp as claimed in claim 2, characterized in that the pre-determined temperature corresponds to 75–110% of the lowest temperature of the range of temperatures at which the mercury-vapor pressure above the amalgam (2) is relatively stable.

4. A low-pressure mercury vapor discharge lamp as claimed in claim 1, characterized in that the releasing means (4) comprises a resilient means (6) made of a shape-memory alloy, the transformation temperature of the shape-memory alloy being chosen to correspond substantially to the predetermined temperature, the resilient means (6) being substantially closed when the shape-memory alloy reaches the transformation temperature of the shape-memory alloy.

5. A low-pressure mercury vapor discharge lamp as claimed in claim 1, characterized in that the product of the mercury pressure $P_{Hg}$ and the internal diameter $D_{in}$ of the discharge vessel (10) is in the range $0.13 \leqq p_{Hg} \times D_{in} \leqq 8$ Pa·cm.

6. A low-pressure mercury vapor discharge lamp as claimed in claim 5, characterized in that the product of the mercury pressure $p_{Hg}$ and the internal diameter $D_{in}$ of the discharge vessel (10) is in the range $0.13 \leqq p_{Hg} \times D_{in} \leqq 4$ Pa·cm.

7. A low-pressure mercury vapor discharge lamp as claimed in claim 1, characterized in that the discharge vessel (10) contains less than 0.1 mg mercury.

8. A low-pressure mercury vapor discharge lamp as claimed in claim 1, characterized in that the releasing means (4) is open during lamp-off periods.

9. A compact fluorescent lamp comprising a low-pressure mercury-vapor discharge lamp as claimed in claim 1, the compact fluorescent lamp comprising:

at least two dual-shaped lamp parts (35; 36; 37), each comprising a first tube (41; 45; 49) and a second tube (43; 47; 51), the first tube (41; 45; 49) and the second tube (43; 47; 51) at a first end portion (41*a*, 43*a*; 45*a*, 47*a*; 49*a*, 51*a*) of each tube (41, 43; 45, 47; 49, 51) being interconnected via a tube interconnection means (42; 46; 50), a discharge path being formed through the tubes (41, 43; 45, 47; 49, 51) between a first (20*a*) and a second electrode (20*b*), each electrode (20*a*, 20*b*) being provided at a second end portion (41*b*; 51*b*) of one of the tubes (41; 51), the second end portions (41*b*; 51*b*) facing away from the first end portions (41*a*; 51*a*), the electrodes (20*a*; 20*b*) being provided at extreme ends of the fluorescent lamp, further second end portions (43*b*; 45*b*; 47*b*; 49*b*) of the tubes (43; 45; 47; 49) being provided with a sealed end, bridge parts (44; 48) for mutually connecting tubes (43, 45; 47, 49) of adjacent dual-shaped lamp parts (35, 36; 36, 37) being provided in the proximity of the second end portions (43*b*, 45*b*; 47*b*, 49*b*) of the tubes (43, 45; 47, 49), at least one of the further second end portions (45*b*) being provided with the container (3) comprising the amalgam (2).

10. A compact fluorescent lamp as claimed in claim 9, characterized in that a heating means (25) is provided at the further second end portion (45*b*).

11. A compact fluorescent lamp as claimed in claim 9, characterized in that the tube interconnection means (42; 46; 50) is either a bridge portion or a bent portion.

12. A compact fluorescent lamp as claimed in claim 9, characterized in that a lamp housing (70) is attached to the discharge vessel (10) of the low-pressure mercury-vapor discharge lamp, which lamp housing is provided with a lamp cap (71).

* * * * *